US007413254B2

(12) United States Patent
Petre, Jr.

(10) Patent No.: US 7,413,254 B2
(45) Date of Patent: Aug. 19, 2008

(54) QUICK-ASSEMBLY STOOL

(76) Inventor: Noel W. Petre, Jr., 360 Goat Creek Cutoff Rd., Kerrville, TX (US) 78028

( * ) Notice: Subject to any disclaimer, the term of this patent is extended or adjusted under 35 U.S.C. 154(b) by 0 days.

(21) Appl. No.: 11/614,605

(22) Filed: Dec. 21, 2006

(65) Prior Publication Data

US 2008/0150333 A1 Jun. 26, 2008

(51) Int. Cl.
*A47C 7/00* (2006.01)

(52) U.S. Cl. ..... 297/440.1; 297/195.11; 297/16.2; 108/154; 248/431

(58) Field of Classification Search ..... 297/440.1, 297/440.13, 440.22, 451.2, 451.8, 463.1, 297/195.11, 16.2; 108/154, 183, 158.12, 108/158.13; 248/431, 165, 432, 164, 151, 248/188

See application file for complete search history.

(56) References Cited

U.S. PATENT DOCUMENTS

| | | | | | |
|---|---|---|---|---|---|
| 64,694 | A | | 9/1867 | Olds | |
| 576,657 | A | | 2/1897 | Chapman | |
| 647,171 | A | * | 4/1900 | Wiles | 108/118 |
| 799,455 | A | | 9/1905 | Cornell | |
| 1,172,439 | A | | 2/1916 | Crozier | |
| 1,477,233 | A | | 12/1923 | Alexander | |
| 2,368,740 | A | | 2/1945 | Blomgren | |
| 3,338,189 | A | | 8/1967 | Xavier | |
| 3,396,933 | A | | 8/1968 | Ward | |
| 3,566,808 | A | * | 3/1971 | Slate et al. | 108/157.14 |
| 4,184,711 | A | * | 1/1980 | Wakimoto | 297/16.2 |
| 4,423,849 | A | | 1/1984 | Jordan | |
| 4,717,108 | A | | 1/1988 | Liedle | |
| 4,934,638 | A | | 6/1990 | Davis | |
| 5,975,626 | A | * | 11/1999 | Aycock | 297/16.1 |
| 6,135,557 | A | | 10/2000 | Gustafsson | |
| 6,615,746 | B2 | | 9/2003 | Bart | |
| 6,814,010 | B2 | | 11/2004 | Bart | |
| 7,216,937 | B2 | * | 5/2007 | Key et al. | 297/452.18 |

OTHER PUBLICATIONS

"The Basic Stool", www.guitarstools.com/basic.htm—this is a depiction of the inventor's prior art stool.
"The Classical Tool", www.guitarstools.com/classical.htm—this is another depiction of the inventor's prior art stool.
"The Stage Stool", www.guitarstools.com/stage.htm—this is another depiction of the inventor's prior art stool.
"Stage Stool Photos", www.guitarstools.com/stagephotos.htm—this is another depiction of the inventor's prior art stool.

* cited by examiner

*Primary Examiner*—Laurie K Cranmer
(74) *Attorney, Agent, or Firm*—Eric W. Cernyar

(57) ABSTRACT

A portable, easily assembled and disassembled three-legged stool or stool kit includes a seat with a quick-release leg-fastening assembly, three legs having keyhole slots to engage with the quick-release leg-fastening assembly, and a substantially planar leg bracket oriented below and parallel with the seat that has three symmetrically-oriented elongated slots to receive and orient the legs. At least one of the legs has multiple, spaced-apart sets of opposing grooves for supporting a removable, cantilevered platform such as a footrest or a drink holder. When assembled, the legs are oriented in a structurally strong and rigid fashion to support the seat.

16 Claims, 9 Drawing Sheets

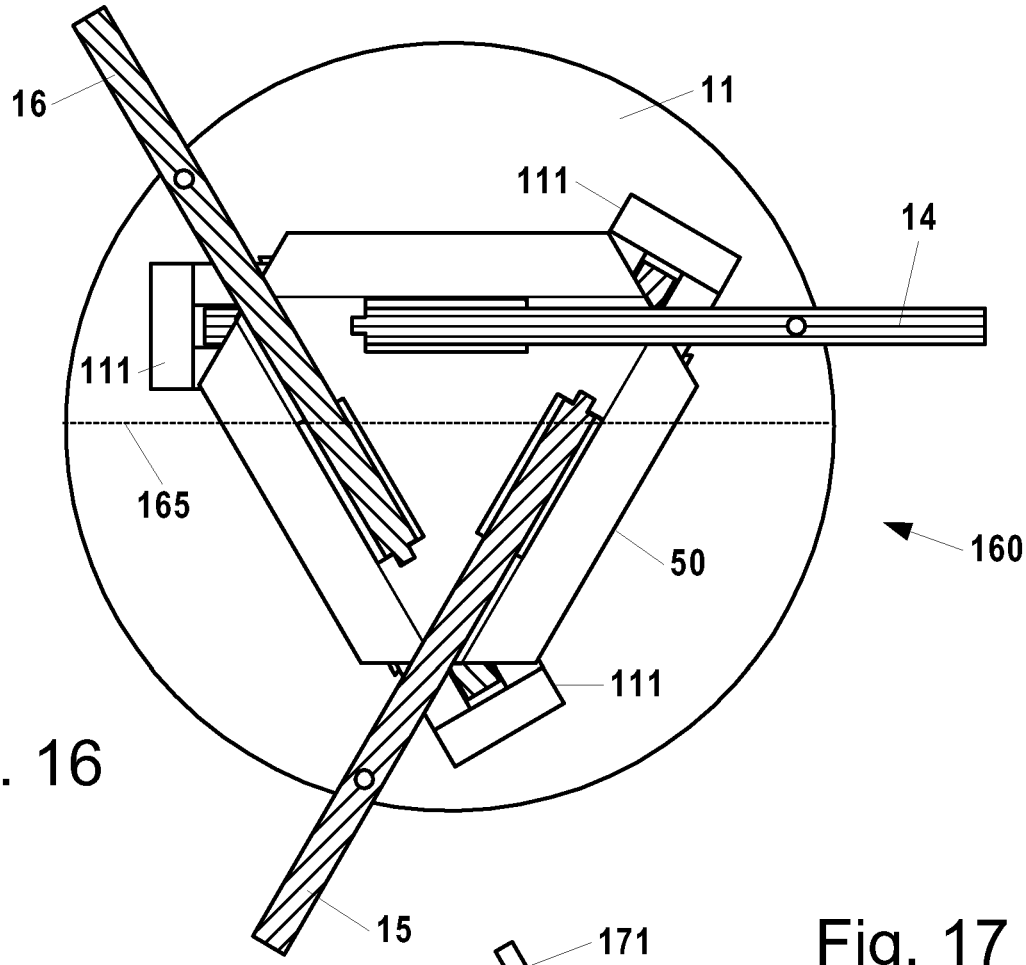
Fig. 16
Fig. 17
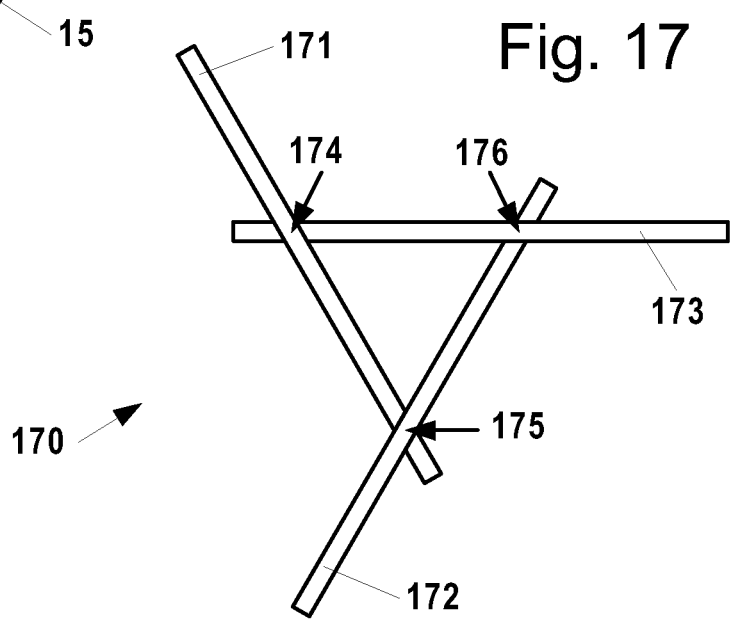

QUICK-ASSEMBLY STOOL

FIELD OF THE INVENTION

This invention relates generally to stools, and more particularly to portable three-legged stool kits that can be quickly assembled for use on stage, and thereafter quickly disassembled for transport.

BACKGROUND OF THE INVENTION

After several decades pursuing a typical American career, the inventor, Mr. "Pete" Petre, retired to Kerville, Tex., where he, among other things, enjoys playing the guitar and tinkering with things in his workshop. In December, 2002, Mr. Petre, who has a bad back, found conventional guitar stools to be uncomfortable. So he constructed his own guitar stool—a predecessor to the stool described in this specification. Others liked Mr. Petre's predecessor guitar stool, so Mr. Petre made more of them and began selling them to various customers, doing business under the name P3 Guitar Stools.

Recently—less than one year prior to the filing date of this application—Mr. Petre developed a new stool or stool kit designed to be quickly assembled and broken down. This patent application is intended to cover Mr. Petre's new and improved collapsible stool and stool kit.

SUMMARY OF THE INVENTION

The collapsible stool or stool kit includes a seat with a quick-release leg-fastening assembly, three legs having keyhole slots to engage with the quick-release leg-fastening assembly, and a substantially planar leg bracket oriented below and parallel with the seat that has three symmetrically-oriented elongated slots to receive and orient the legs. At least one of the legs has multiple, spaced-apart sets of opposing grooves for supporting a removable, cantilevered platform such as a footrest or a drink holder. When assembled, the legs are oriented in a structurally strong and rigid fashion to support the seat.

The collapsible stool or stool kit includes several improvements over Mr. Petre's predecessor stool, one or more of which, or some combination of which, may be novel and non-obvious. It will be understood, however, that the invention is defined and limited by the elements and limitations set forth in the claims, and not by improvements, aspects, and attributes described herein that are not recited in the claims themselves.

One of the improvements is a quick-release bracket assembly on the bottom of the seat. The first embodiment of the quick-release bracket assembly included three leg-connecting brackets, each of which is configured to grasp the upper section of a stool leg. Each leg bracket supports a tapered locking pin having a wide-diameter section and a narrow-diameter section that slides between open and closed positions. Another embodiment of the quick-release bracket assembly is described in the detailed description section of this specification.

Another improvement is a keyhole slot that was cut into the top of each leg to accommodate the tapered pin in both the locked and unlocked positions. This feature is described in greater detail below.

Yet another improvement is a substantially planar leg bracket oriented below the seat that has three symmetrically-oriented elongated slots designed to receive, space apart, and orient the legs into their proper, cantilevered position that is both very structurally strong and aesthetically pleasing.

Unlike Mr. Petre's predecessor stools, the legs in the collapsible stool or stool kit do not intersect one another in three-dimensional space. But if one were to illustrate a projection of the stool legs into the horizontal, two-dimensional plane of the seat, it would mark three substantially linear segments intersecting at three equidistant points. This design makes the stool exceptionally resistant to various torques and twisting forces.

Yet another improvement is the relative placement of an opposing pair of notches on each leg that allows gravity to cause the legs to cantilever against the leg bracket so that before an attempt is ever made to connect the legs to the seat, the tops of the legs are spatially oriented to connect to the quick-release bracket assembly on the bottom of the seat.

Three more improvements are that the upper portion of the legs are wider than the portion of the leg that passes through a leg bracket, the provision of a dowel on each leg, and a cooperating notch on each leg bracket slot to fool-proof the assembly process. The cantilevered platforms, such as a foot rest or a drink and guitar pick holder, have also been improved by providing a notch within the slots to fool-proof the placement of cantilevered platforms on the legs of the stool.

Those of ordinary skill in the art will appreciate these and other improvements described further below in the detailed description and the accompanying drawings.

BRIEF DESCRIPTION OF THE DRAWINGS

FIG. 16 is a bottom view of a collapsible three-legged stool of the type depicted in FIG. 1, which illustrates the projection of the stool legs into the plane of the stool seat.

FIG. 17 is a simplified diagram illustrating how the projection of the stool legs into the plane of the stool seat forms three substantially linear segments intersecting at three equidistant points.

DETAILED DESCRIPTION

Figure 1:
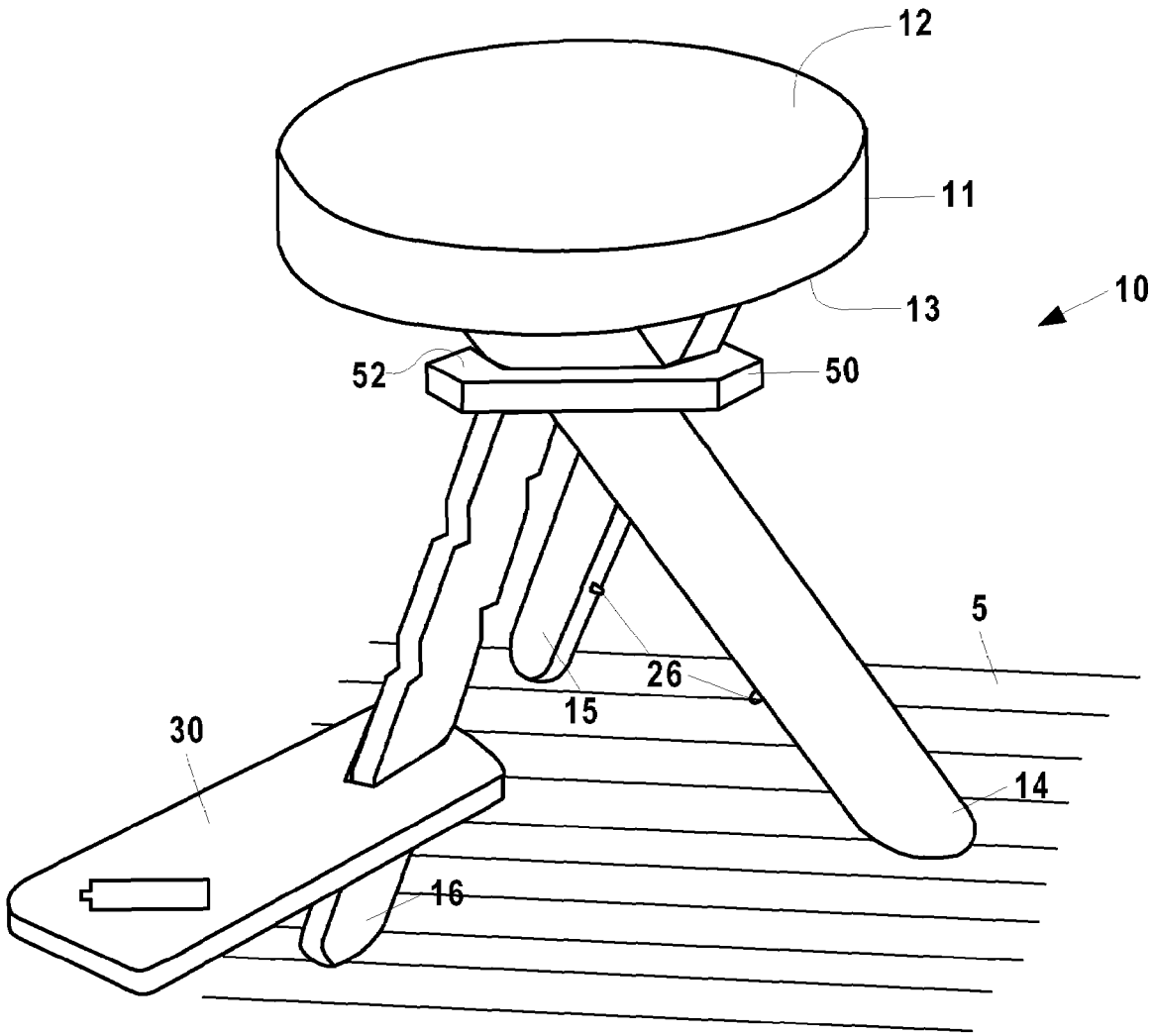
FIG. 1 is a perspective view of one embodiment of a collapsible three-legged stool made in accordance with the present invention.

FIG. 1 is a perspective view of one embodiment of a collapsible three-legged stool 10 made in accordance with the present invention. The stool 10, which rests upon a support surface 5 (such as the ground, a floor, or a stage platform), includes a horizontally-oriented seat 11 having a top 12 and a bottom 13, three non-intersecting legs 14, 15, and 16, and a substantially planar, horizontally-oriented leg bracket 50 (FIG. 5) that has three symmetrically-oriented, elongated slots 51 for receiving and orienting the legs 14, 15, and 16. The legs 14, 15, and 16 extend downwardly and diagonally from the seat 11 through the leg bracket slots 51 and into terminating contact with the support surface 5. The three legs 14, 15, and 16 connect to the seat 11 by engagement with a quick-release leg-fastening assembly 110 or 140 (FIGS. 11, 14), at three symmetrically-spaced places on the seat bottom 13.

The preferred diameter of the seat is between about 12 and 14 inches. Different stools 10 have different heights. For example, a basic stool 10 has a seat height, when assembled, of about 22 inches above the floor 5. A stage stool 10 might have a seat height, when assembled, of about 26 inches above the floor 5.

Figure 2A:
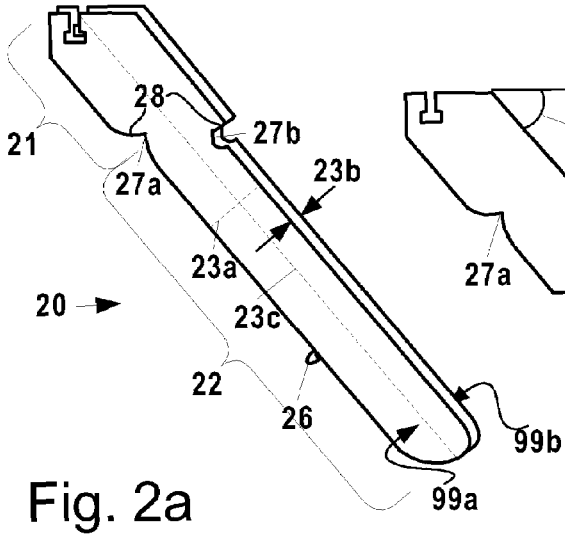
FIGS. 2*a* and 2*b* illustrate two embodiments of legs for the collapsible stool of FIG. 1.
Figure 2B:
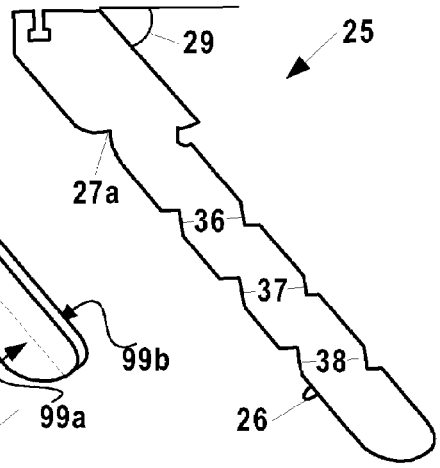

FIGS. 2*a* and 2*b* illustrate two types of legs—a standard leg 20, and an accessory-supporting leg 25—for collapsible stools 10 of the type shown in FIG. 1. Each of the legs 20, 25 is defined by an upper section 21 and a lower section 22, and has width, thickness, and length dimensions 23*a-c*. The width dimension 23*a* is at least two times, and preferably at least three times, its thickness dimension 23*b*. When assembled, each of the legs 20, 25 has substantially planar opposing faces 99*a*, 99*b* defined by the leg's width and length dimensions 23*a*, 23*c*, and lying within vertical planes.

In a typical embodiment, a leg 20, 25 will have a width 23*a* of about 3½ inches across the upper section 21, a width 23*a* of about 2 15/16 inches across the lower section 21, a thickness 23*b* of about ¾ inches, and a length 23*c* of anywhere between about 20 and 28 inches, depending on the stool height desired.

Each leg's lower section 22 is sized to fit through one of the leg bracket slots 51—which may typically be about 3 inches by ⅞ of an inch—but its upper section 21 is sized to be too big to pass through the leg bracket slot 51, thereby limiting travel of anything more than the leg's lower section 21 through the leg bracket slot 51. Furthermore, opposing leg bracket notches 27*a*, 27*b* are provided at the intersection of the upper and lower sections 21 and 22, the leg bracket notches 27*a*, 27*b* defining an abutment surface 28 on the leg's upper section 21 that rests upon portions of the top surface 52 of the leg bracket 50 adjacent the elongated slot 51 through which the leg 20, 25 is inserted. The notches 27*a*, 27*b* and abutment surface 28 help the leg 20, 25 to slide into its proper, cantilevered position, and to keep it there when the stool base is turned over in order to connect it with the seat 11. In the cantilevered position, the tops of the legs 20, 25 are spatially oriented to connect to the quick-release bracket assembly 110, 140 on the bottom 13 of the seat 11. Each leg 20, 25, also has a terminal top end 41 (FIG. 4) for contacting the bottom 13 of the seat 11 at an acute angle 29 of between 45 and 75 degrees below the horizontal plane with respect to the length dimension 23*c* of the leg 20, 25, and wherein the terminal top end 41 is parallel with the abutment surface 28.

Figure 3:
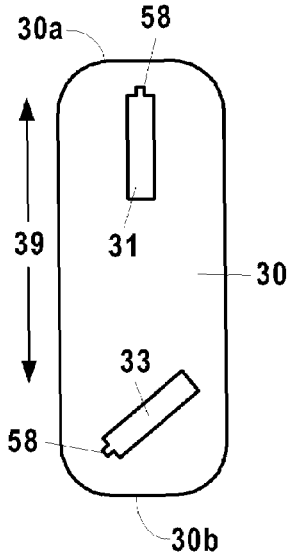
FIG. 3 is a top view of a slotted cantilevered platform for the collapsible stool of FIG. 1.

FIG. 3 illustrates one of the accessories—namely, a removable, cantilevered platform 30—designed to be supported on the accessory-supporting leg 25 of FIG. 2*b*. To support the platform 30, the accessory-supporting leg 25 has multiple, spaced-apart sets 36, 37, and 38 of opposing grooves for supporting the cantilevered platform 30 at any one of multiple selectable heights. The grooves of each spaced-apart set 36, 37, and 38 are placed, in relation to each other and to the accessory-supporting leg 25, to keep any cantilevered platform 30 supported thereby level, in a horizontal plane.

Figure 6A:
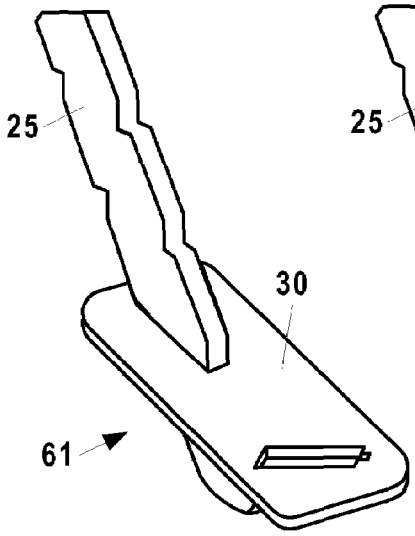
FIGS. 6*a*, 6*b*, and 6*c* are perspective views of three different orientations of a cantilevered footrest with respect to a leg on which it rests.
Figure 6B:
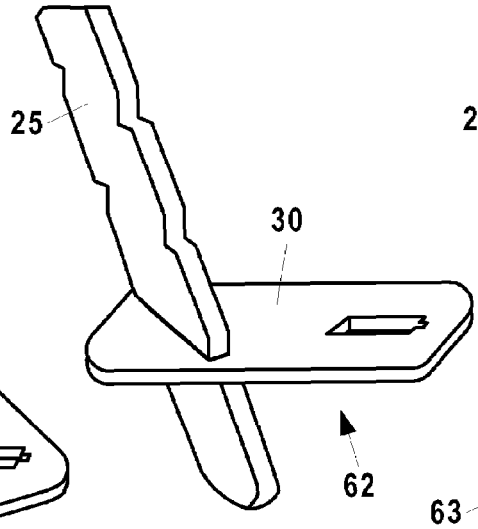
Figure 6C:
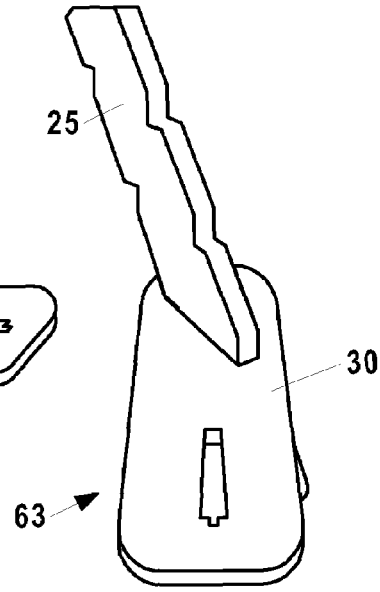

The cantilevered platform 30 is provided with at least a first slot 31 adjacent one end 30*a* of the platform 30, and parallel with the lengthwise dimension 39 of the platform 30. The first slot 31 is sized to receive the lower section 22 of the accessory-supporting leg 25 and engage one of the sets 36, 37, and 38 of opposing grooves thereof. The cantilevered platform 30 may also be provided with a second slot 33 adjacent a second end 30*b*, opposite the first end 30*a*, of the cantilevered platform 30, oriented in a direction diagonal to the lengthwise dimension 39 of the cantilevered platform 30. Like the first slot 31, the second slot 33 is sized to receive the accessory-supporting leg 25 and engage one of the sets 36, 37, 38 of grooves thereof. The provision of the first and second slots 31 and 33 enables the cantilevered platform 30 to serve as a left-or-right foot rest that can be connected to the accessory-supporting leg 25 in three different orientations 61, 62, and 63 (FIGS. 6*a*-6*c*).

A preferred length for a cantilevered platform 30 suitable as a foot rest is about 14 inches. Also, the sets 36, 37, and 38 of opposing grooves are preferably spaced apart so that the foot rest can be adjusted from between 3 and 10 inches elevation above the floor.

Figure 4:
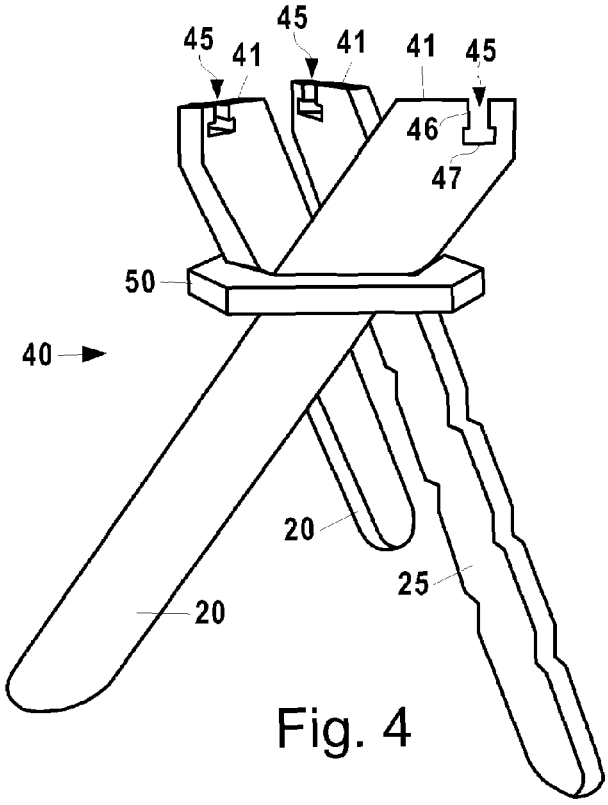
FIG. 4 is a perspective view of the base of a collapsible stool of the type shown in FIG. 1.

FIG. 4 is a perspective view of the base 40 of a collapsible stool 10 of the type shown in FIG. 1. The base 40 comprises two standard legs 20, an accessory-supporting leg 25, and a leg bracket 50. The base 40 is shown separated from the seat 11 in order to illustrate how the legs 20, 25 interlock with the quick-release leg-fastening assembly 110 or 140 (FIGS. 11, 14) of the seat 11. The terminal top end 41 of each leg has a keyhole slot 45 for engaging a locking pin 120 (FIG. 12) on the quick-release leg-fastening assembly 110 or 140 (FIGS. 11, 14).

Figure 11:
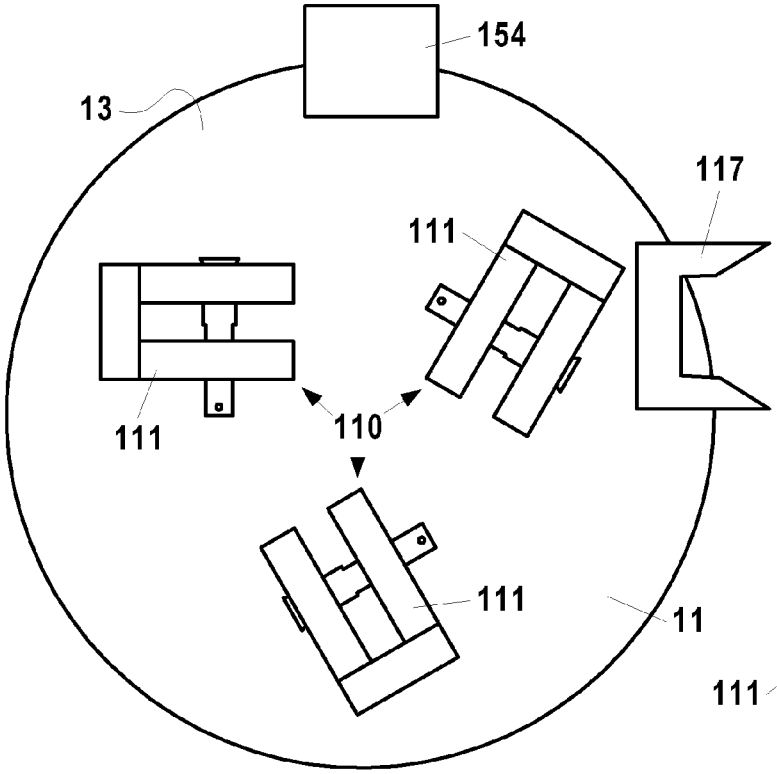
FIG. 11 is a bottom view of the stool seat with one embodiment of a quick-release bracket assembly.

FIG. 11 illustrates one embodiment of a quick-release bracket assembly 110, comprising three terminal brackets 111, each terminal bracket 111 being comprised of three blocks 112, 113, and 114 joined together to grasp the upper section 21 of one of the legs 20, 25 between blocks 113 and 114. Block 112 serves as a stop for the leg 20, 25.

Figure 12:
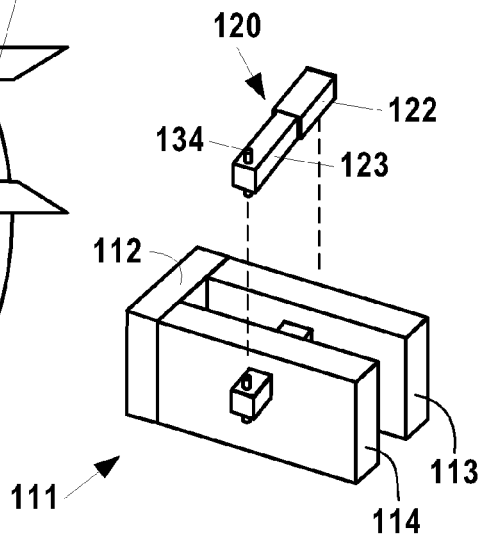
FIG. 12 is a perspective view of one of the leg-connecting brackets and locking pins of the quick-release bracket assembly depicted in FIG. 11.

FIGS. 12 illustrates the terminal bracket 111 in more detail. Each terminal bracket 111 has a locking pin or plug 120 operable to be moved between open 132 and closed 131 positions. FIGS. 11-13 depict a rectilinear locking pin 120, but alternative shapes, such as a cylindrical shape, for the locking pin 120 are also suitable. The locking pin 120 has a narrow diameter section 123 and a wide-diameter section 122 terminating with a flared end 133. During construction, the locking pin 120 is inserted through cooperating, correspondingly-sized holes in blocks 113 and 114 of the terminal bracket 111. Afterwards, a dowel 134 is inserted through a correspondingly-sized hole in the narrow diameter section 123 of the locking pin 120, near the end of the locking pin 120 that is opposite of the flared end 133. The flared end 133 prevents the locking pin 120 from traveling too far in one direction, and the dowel 134 limits the travel of the locking pin 120 in the opposite direction. Together, the flared end 133 and the dowel 134 prevent the locking pin 120 from being disconnected from the terminal bracket 111, while allowing the locking pin 120 to travel between its open 132 and closed 131 positions.

Figure 13A:
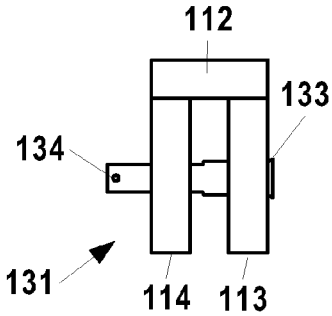
FIGS. 13*a* and 13*b* illustrate the closed and open positions, respectively, of a locking pin in relation to a leg-connecting bracket.
Figure 13B:
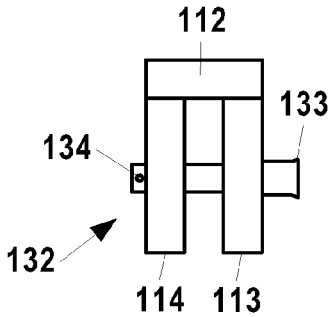

FIGS. 13*a* and 13*b* illustrate the closed and open positions, respectively, of the locking pin 120 in relation to the leg-connecting bracket 111. When the locking pin 120 is in its closed position 131, the wide-diameter section 122 of the locking pin 120 protrudes into and dominates the region of the bracket 111 between leg-grasping blocks 113 and 114. When the locking pin 120 is in its open position 132, the narrow-diameter section 122 of the locking pin 120 dominates the region of the bracket 111 between leg-grasping blocks 113 and 114.

Figure 14A:
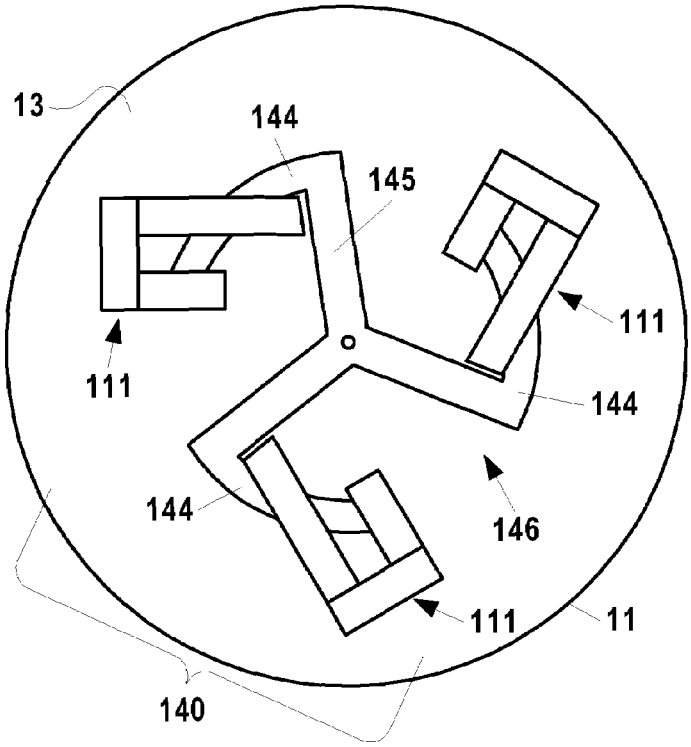
FIGS. 14*a* and 14*b* illustrate the open and closed positions, respectively, of a "rotating lock" embodiment of a quick-release bracket assembly for a stool seat.
Figure 14C:
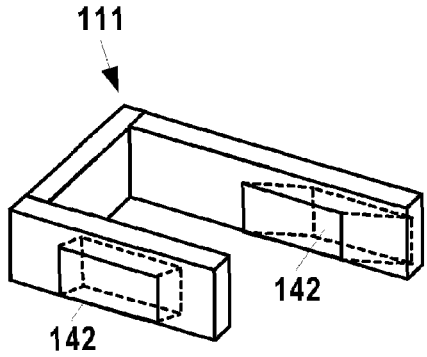
FIG. 14*c* is a perspective view of one of the leg-connecting brackets of the quick-release bracket assembly depicted in FIGS. 14*a* and 14*b*.
Figure 14B:
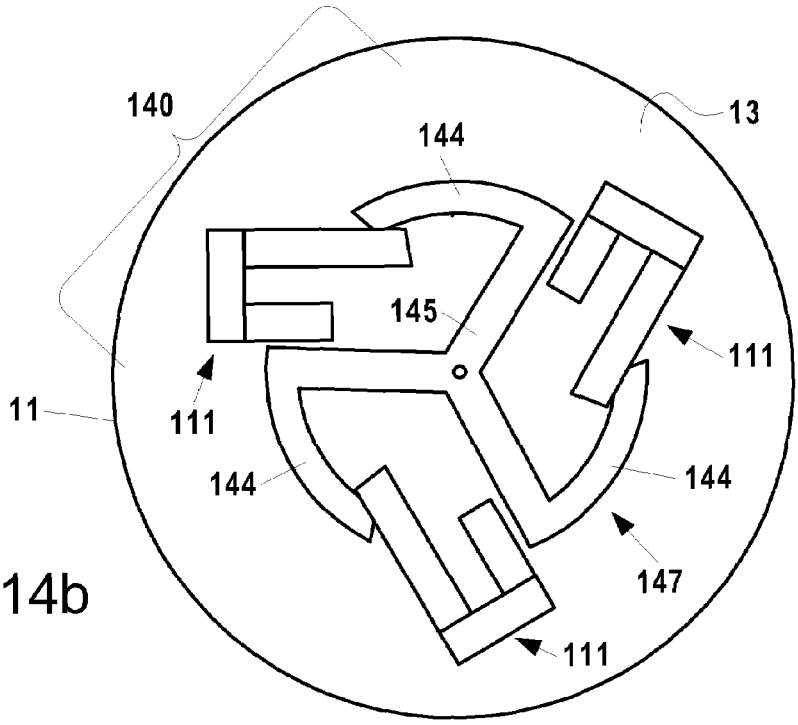

FIGS. 14*a* and 14*b* illustrate another embodiment of a quick-release bracket assembly 140, and FIG. 14*c* provides a perspective view of one of the leg-connecting brackets 111 of this quick-release bracket assembly 140. The quick-release leg-fastening assembly 140 comprises three multi-walled terminal brackets 111, each terminal bracket 111 being configured to grasp the upper section 21 of one of the legs 20, 25. Each terminal bracket 111 includes a passageway 142 through at least one of its walls. A rotary lock 145 is pivotally attached to the bottom 13 of the seat 11. The rotary lock 145 has three arc-shaped arms 144 sized to pass through the passageways 142 of each of the terminal brackets 111. The rotary lock 145 pivots between open 146 and closed 147 positions.

Turning back to FIG. 4, the keyhole slot 45 on the terminal top end 41 of each leg 20, 25 comprises a base 47 and a passageway 46 connecting the base 47 to the terminal top end 41. The base 47 is shaped to partially encircle the locking pin 120 about its wide-diameter section 122 (or, alternatively, to partially or completely encircle one of the arc-shaped arms 144 of the rotary lock 145). The passageway 46 is wide enough to allow passage of the narrow-diameter section 123 of the locking pin 120 therethrough, when the locking pin 120 is in its open position 132. But passageway 46 is too narrow to permit passage of the wide-diameter section 122 of the locking pin 120 therethrough, when the locking pin 120 is in its closed position 132.

Figure 5:
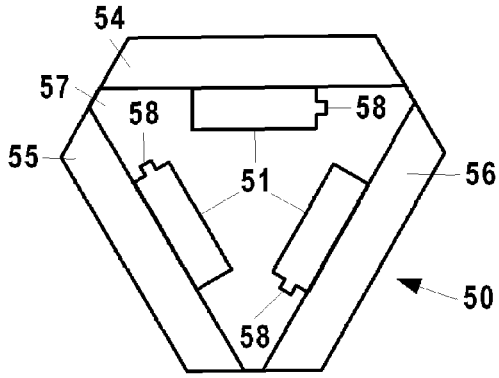
FIG. 5 is a top view of a planar leg bracket with three slots for receiving the legs and assembling them in a symmetrical, non-intersecting relation to each other.

FIG. 5 is a top view of one embodiment of the planar leg bracket 50. In the depicted embodiment, the leg bracket 50 is assembled from four different pieces 54, 55, 56, and 57 for ease of fabrication. Alternatively, the leg bracket 50 could be fabricated as a single, integral piece. The leg bracket 50 has three, symmetrically-spaced slots 51 for receiving the legs 20, 25 and assembling them in a symmetrical, non-intersecting relation to each other.

Comparing FIGS. 2-5 together, each leg's lower section 21 is configured, and the leg bracket slots 51 are configured, so that each leg 20, 25 can only be inserted through a slot 31, 33, or 51 of a leg bracket 50 or cantilevered platform 30 when the leg 20, 25 is properly aligned with respect to the slot 31, 33, or 51. In one embodiment, this is accomplished by providing a dowel 26 that protrudes from each leg's lower section 21, and a cooperating notch 58 in each of the slots 31, 33, or 51, the dowel 26 and cooperating notch 58 serving to permit each leg 20, 25 to be inserted through the slot 31, 33, or 51 only when the leg 20, 25 is properly aligned with respect to the slot 31, 33, or 51.

In an alternative embodiment (not shown), the legs 20, 25 could be shaped to have an elongated teardrop cross-section and the slots cut to accommodate the teardrop shape. This alternative embodiment would provide the same benefit as the dowel and notch configuration depicted in the drawings.

Figure 7:
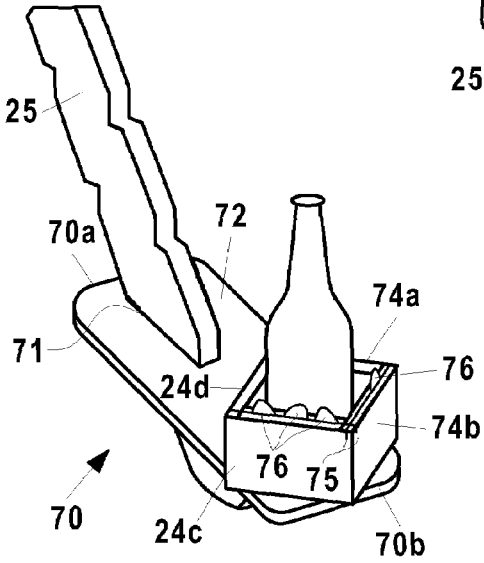
FIG. 7 is a perspective view of a drink and guitar pick accessory platform resting upon a stool leg.
Figure 8:
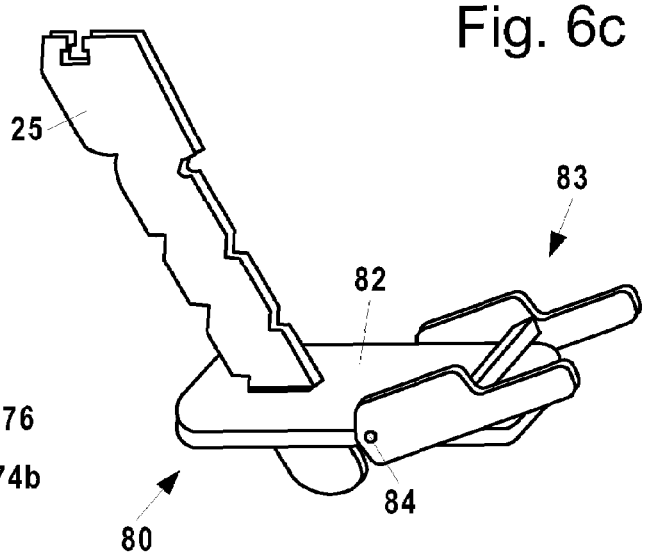
FIG. 8 is a perspective view of a retractable guitar holder platform resting upon a stool leg.

FIGS. 7 and 8 depict other embodiments of cantilevered platforms designed to be supported on the accessory-supporting leg 25 of FIG. 2*b*. FIG. 7 depicts a drink and guitar pick accessory platform 70 resting upon and supported by a stool leg 25. The drink and guitar pick accessory platform 70 comprises an accessory caddy 73—more particularly, a drink holder—disposed on one end 70*b* of a cantilevered platform 72, opposite the end 70*a* adjacent slot 71 through which leg 25 is inserted. The accessory caddy 73 is formed from four blocks 74*a-d,* two of which have slits 75 for holding guitar picks 76.

FIG. 8 depicts a cantilevered, retractable guitar holder platform 80, resting upon a stool leg 25. The retractable guitar holder platform 80 comprises a retractable guitar holder 83, for supporting the body of a guitar, pivotally connected at pivot point 84 to the cantilevered platform 82. FIG. 8 depicts the guitar holder 83 in its extended position. In its retracted position (not shown), the guitar holder 83 leans against the leg 25, enabling the retractable guitar holder platform 80 to serve as a foot rest. To support the neck of the guitar, an instrument bracket 117 (FIG. 11) is attached to the bottom 13 of the seat 11 and oriented in a direction parallel to one of the leg-connecting brackets 111.

Figure 9:
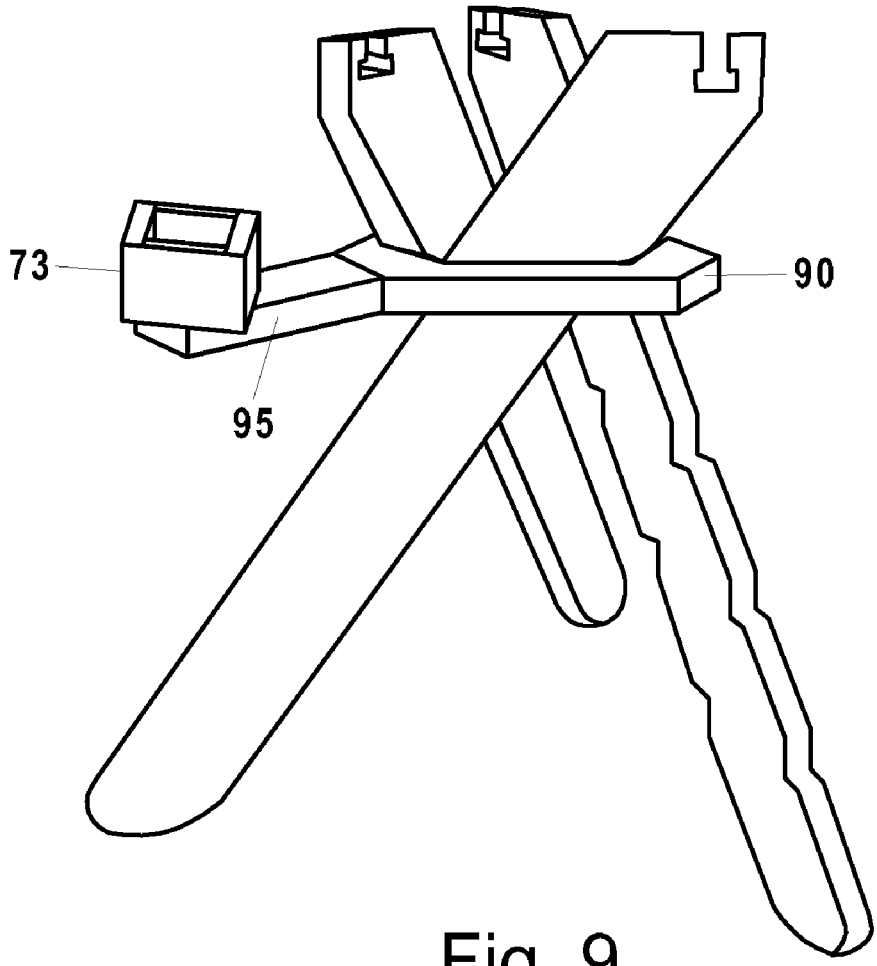
FIG. 9 is a perspective view of another embodiment of a stool base with a planar leg bracket that includes a drink accessory extension.
Figure 10:
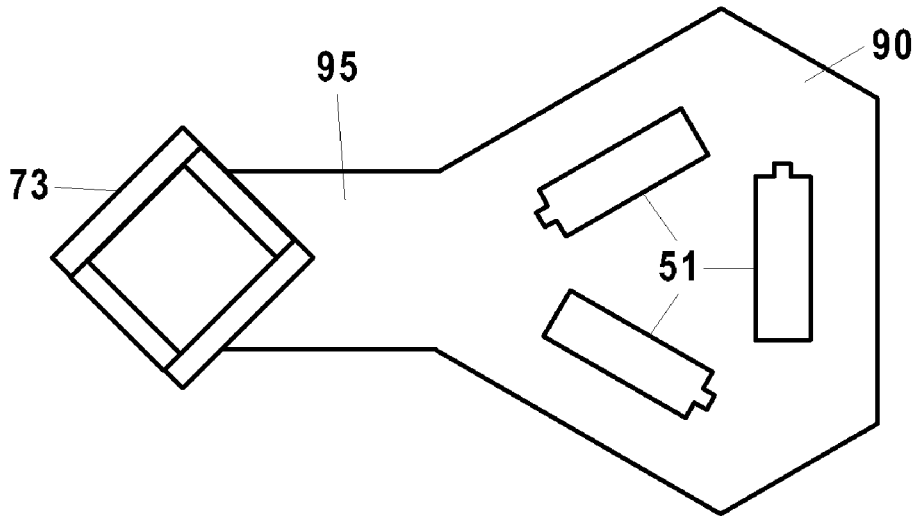
FIG. 10 is a top view of the planar leg bracket depicted in FIG. 10.
Figure 15:
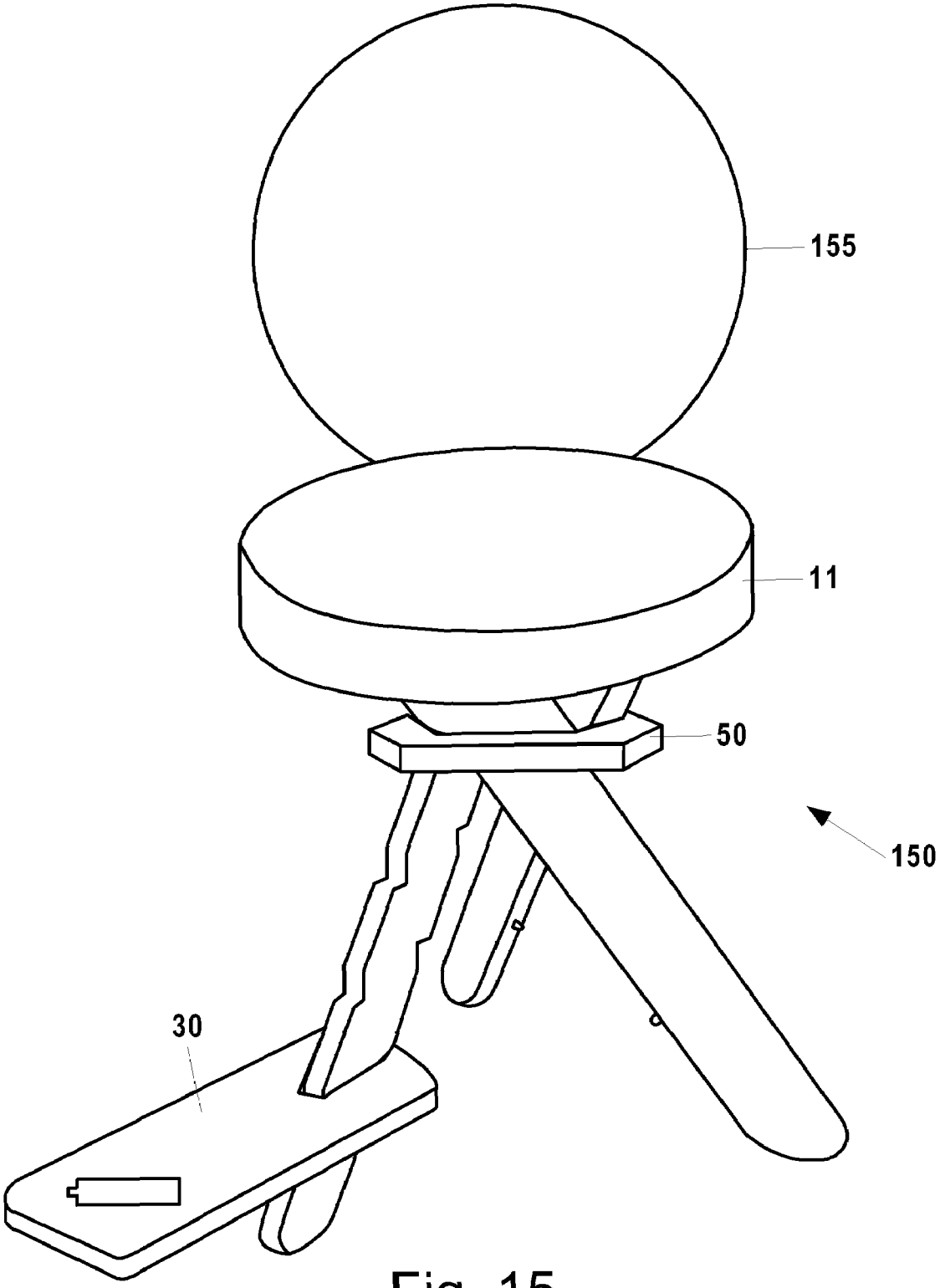
FIG. 15 is a perspective view of a collapsible three-legged stool made that includes a backrest.

FIGS. 9-10 depict an alternative embodiment of a leg bracket 90 with an extension 95 for supporting an accessory caddy 73. FIG. 15 depicts an embodiment of a collapsible three-legged stool 150 that includes a backrest 155. As shown in FIG. 11, a connecting piece 154 may be provided to join the backrest 155 to the seat 11. The connecting piece 154 is preferably of a kind that permits the backrest 155 to be quickly removed from the seat 11 without the use of tools. Alternatively, the connecting piece 154 includes a hinge that allows the backrest 155 to fold onto the top 12, or alternatively onto the bottom 13, of the seat 11 for storage and transport.

FIG. 16 is a bottom view 160 of a collapsible three-legged stool 10 of the type depicted in FIG. 1, which illustrates the projection of the stool legs 14, 15, and 16 into the plane of the stool seat 11. FIG. 17 is a simplified diagram illustrating how the projection 170 of the stool legs 14, 15, and 16 into the plane of the stool seat 11 forms (or can be represented by) three substantially linear (imaginary) segments 171, 172, 173 intersecting at three equidistant points 174, 175, and 176. Preferably, the various parts of the stool 10 are sized and shaped so that upon assembly, the three equidistant points 174, 175, and 176 that mark the intersection of the substantially linear segments 171, 172, and 173 formed by the projection of the stool legs 14, 15, and 16 into the horizontal plane are spaced apart from each other a distance 177 that is at least one-third of a horizontal diameter 165 of the seat 11, thereby enhancing the strength of the three-legged stool 10.

Figure 18:
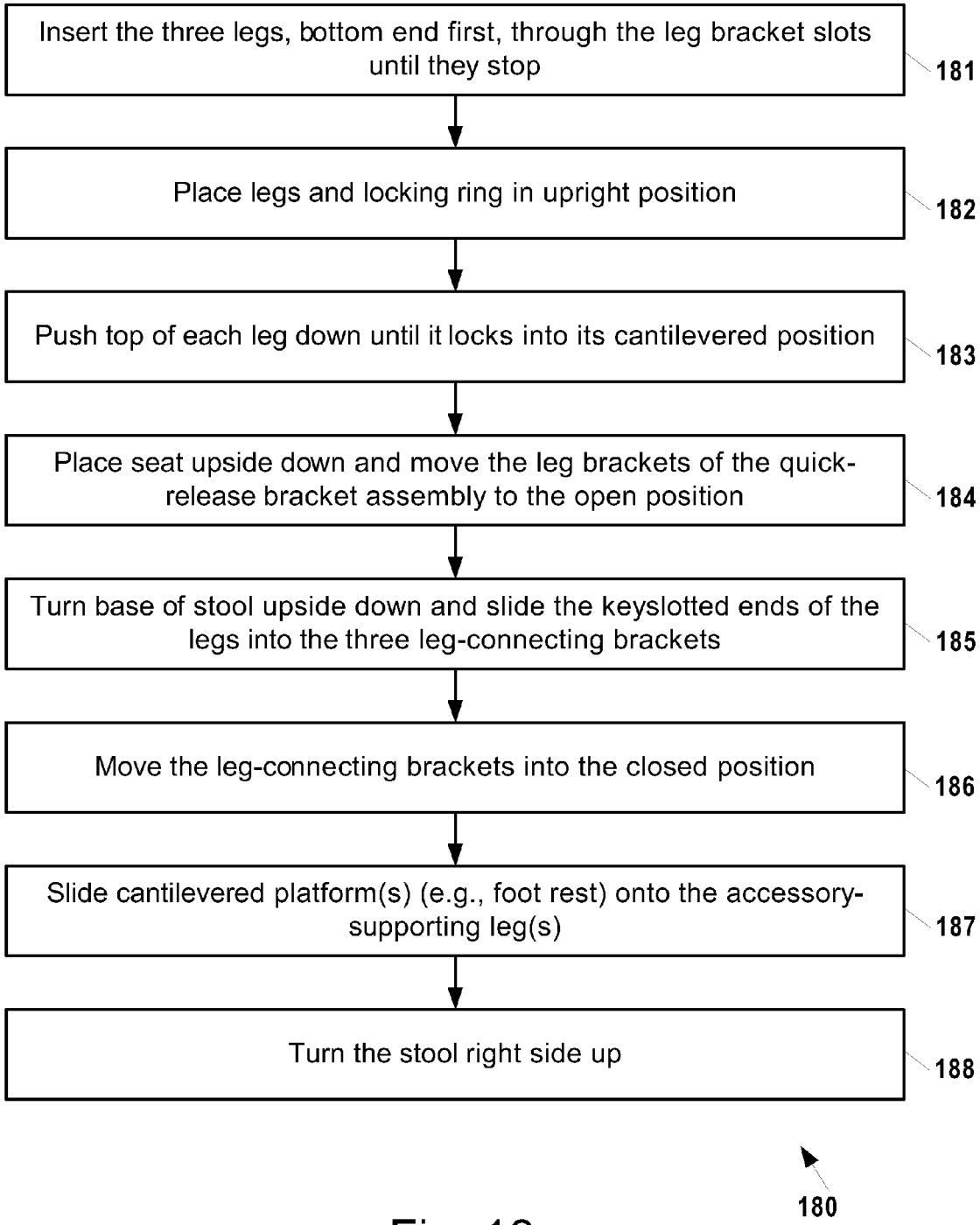
FIG. 18 is a flow chart of a method of assembling the collapsible three-legged stool depicted in FIG. 1.

FIG. 18 provides a flow chart 180 of a method of assembling the collapsible three-legged stool 10. In functional block 181, insert the three legs 14, 15, and 16, bottom end first, through the leg bracket slots 51 until the legs 14, 15, and 16 can go no further. In functional block 182, place the legs 14, 15, and 16 in an upright position. In functional block 183, push the top of each leg down until it locks into its cantilevered position, which completes the assembly of the base 40 of the stool 10. In the cantilevered position, the tops of the legs 14, 15, and 16 are spatially oriented to connect to the quick-release bracket assembly 110 or 140 on the bottom 13 of the seat 11. In functional block 184, place the seat 11 upside down and move the leg brackets 111 of the quick-release bracket assembly 110 or 140 into the open position. In functional block 185, turn the base 40 of the stool 10 upside down and slide the keyslotted ends of the legs into the three leg-connecting brackets 111. In functional block 186, move the locks of the leg-connecting brackets 111 into their closed position. In functional block 187, slide any desired cantilevered platforms 30, such as a foot rest, a drink and guitar pick accessory platform 70, or a retractable guitar holder platform 80, onto one or more of the accessory-supporting legs 25 of the stool 187. In functional block 188, turn the stool 10 right side up.

The structural support pieces of the stool are preferably crafted from solid oak wood, with various components thereof bonded together without nails, screws, or other metal fasteners, but instead with epoxy glue and wooden dowels. The wood components are preferably finished with a wax. But it will be understood that the structural support support pieces may be crafted from other materials, such as molded plastic.

The seat 11 is preferably cushioned with about two inches of motorcycle seat foam, and professionally upholstered with a customer's choice of color, or, alternatively, with an animal skin cover.

The portable stool 10 is preferably sold with a canvas bag (not shown) with multiple compartments sized and shaped to keep the legs 14, 15, 16, the leg bracket 50, and the seat 11 from rubbing each other during transport.

It will be understood that a stool 10 may be comprised of any combination of three standard and accessory-supporting legs 20, 25. For example, a stage stool might have three accessory-supporting legs 25, two of which support two adjustable foot rests from about 9 to about 16 inches above the floor, and a third of which supports a drink and guitar pick accessory 73 caddy or a retractable guitar holder 83.

As used in this specification and the claims, "quick-release" refers to locking pin or locking arm arrangements operable to be switched from between their closed and open or locked and unlocked positions by hand, without the use of any tools. As used in the claims, reference to a "locking pin" is intended to be co-extensive in scope with a "locking plug."

Although the foregoing specific details describe various embodiments of the invention, persons reasonably skilled in the art will recognize that various changes may be made in the details of the apparatus or method of this invention without departing from the spirit and scope of the invention as defined in the appended claims.

The present invention includes several independently meritorious inventive aspects and advantages. Unless compelled by the claim language itself, the claims should not be construed to be limited to structures that incorporate all of the inventive aspects, or enjoy all of the advantages, disclosed herein.

It is well established that the claims of the patent serve an important public notice function to potential competitors—enabling them to not only determine what is covered, but also what is not covered—by the patent. And a number of Federal Circuit decisions have emphasized the importance of discerning the patentee's intent—as expressed in the specification—in construing the claims of the patent.

It is my intent that the claims receive a liberal construction and be interpreted to uphold and not destroy the right of the inventor. It is my intent that the claim terms be construed in a charitable and common-sensical manner, in a manner that encompasses the embodiments disclosed in the specification and drawings without incorporating unrecited, unnecessary limitations. It is my intent that the claim terms be construed as broadly as practicable while preserving the validity of the claims. It is my intent that the claim terms be construed in a manner consistent with the context of the overall claim language and the specification, without importing extraneous limitations from the specification or other sources into the claims, and without confining the scope of the claims to the exact representations depicted in the specification or drawings. It is also my intent that not each and every term of the claim be systematically defined and rewritten. Claim terms and phrases should be construed only to the extent that it will provide helpful, clarifying guidance to the jury, or to the extent needed to resolve a legitimate, good faith dispute that is material to the questions of validity or infringement. Otherwise, simple claim terms and phrases should be presented to the jury without any potentially confusing and difficult-to-apply definitional construction.

It is also to be understood that the terminology employed in the Summary of the Invention and Detailed Description sections of this application is for the purpose of describing particular embodiments. Unless the context clearly demonstrates otherwise, is not intended to be limiting. In this specification and the appended claims, the singular forms "a," "an" and "the" include plural references unless the context clearly dictates otherwise. Conversely, it is contemplated that the claims may be drafted to exclude any optional element or be further limited using exclusive terminology as "solely," "only" and the like in connection with the recitation of claim elements or by use of a "negative" limitation. It is also contemplated that any optional feature of the inventive variations described herein may be set forth and claimed independently, or in combination with any one or more of the features described herein.

The headquarters building of the World Intellectual Property Organization bears the following inscription: "Human genius is the source of all works of art and invention; these works are the guarantee of a life worthy of me; it is the duty of the State to ensure with diligence the protection of the arts and inventions." It is my intent that the claims of this patent be construed—and ultimately enforced, if necessary—in a manner worthy of this mandate.

I claim:

1. A three-legged stool comprising:

a seat oriented in a horizontal plane, the seat having a top and a bottom;

a quick-release leg-fastening assembly on the bottom of the seat;

three non-intersecting legs each having width, thickness, and length dimensions, and whose width dimension is at least two times its thickness dimension, each leg also having upper and lower sections;

the three legs being connected to the seat, by the quick-release leg-fastening assembly, at three symmetrically-spaced places on the seat; and a substantially planar leg bracket oriented below the seat and parallel with the horizontal plane, the leg bracket having three symmetrically-oriented elongated slots operable to receive and orient the legs;

wherein each leg extends downwardly and diagonally from the seat at an angle of between 45 and 75 degrees below the horizontal plane, through one of the leg bracket slots, and into terminating contact with a support surface;

wherein each leg has two leg bracket notches at the intersection of its upper and lower sections, the leg bracket notches defining an abutment surface on the upper section of the leg that rests upon portions of the top surface of the leg bracket adjacent the elongated slot through which the leg is inserted;

wherein each leg has a terminal top edge for contacting the bottom of the seat at an acute angle with respect to the length dimension of the leg, and wherein the terminal top edge is parallel with the abutment surface;

wherein the terminal top edge of each leg has a keyhole slot for engaging a locking pin on the quick-release leg-fastening assembly, the locking pin having open and closed positions, the keyhole slot comprising a base shaped to partially encircle the locking pin and a passageway connecting the base to the terminal top edge, wherein the passageway is wide enough to allow passage of the locking pin therethrough in the locking pin's open position but too narrow to permit passage of the locking pin therethrough in the locking pin's closed position.

2. The three-legged stool of claim 1, wherein each leg's lower section is sized to fit through one of the leg bracket slots, but its upper section is sized to be too big to pass through the leg bracket slot, thereby limiting travel of anything more than the leg's lower section through the leg bracket slot.

3. The three-legged stool of claim 1, wherein each leg's lower section is configured, and the leg bracket slots are configured, so that each leg can only be inserted through a leg bracket slot when the leg is properly aligned with respect to the leg bracket slot.

4. The three-legged stool of claim 3, further comprising a dowel protruding from a lower section of each leg, and a cooperating notch disposed in each of the leg bracket slots, the dowel and cooperating notch serving to permit each leg to be inserted through a leg bracket slot only when the leg is properly aligned with respect to the leg bracket slot.

5. The three-legged stool of claim 1, wherein the quick-release leg-fastening assembly comprises three terminal brackets, each terminal bracket being configured to grasp the upper section of one of the legs, and each terminal bracket having a locking pin operable to be moved between open and closed positions.

6. The three-legged stool of claim 5, further comprising a flared end on one end of the locking pin and a dowel on the other end of the locking pin, the flared end and the dowel preventing the locking pin from being disconnected from the terminal bracket.

7. The three-legged stool of claim 1, wherein at least one of the legs is an accessory-supporting leg having a set of opposing grooves for supporting a removable, cantilevered platform.

8. The three-legged stool of claim 7, further comprising a first slot adjacent a first end of the cantilevered platform, the first slot being sized to receive the accessory-supporting leg and engage the grooves thereof.

9. The three-legged stool of claim 8, further comprising a second slot adjacent a second end, opposite the first end, of the cantilevered platform, the second slot also being sized to receive the accessory-supporting leg and engage the grooves thereof;

wherein the cantilevered platform has a lengthwise dimension and the first slot is oriented in a direction parallel with the lengthwise dimension of the cantilevered support; and wherein the second slot is oriented in a direction diagonal to the lengthwise dimension of the cantilevered platform;

whereby the cantilevered platform can be connected to the accessory-supporting leg in three different orientations.

10. The three-legged stool of claim 8, further comprising a dowel protruding from a lower section of the accessory-supporting leg, and a cooperating notch disposed on the first slot in the cantilevered platform, the dowel and cooperating notch serving to permit each leg to be inserted through the first slot of the cantilevered platform only when the leg is properly aligned with respect to the first slot.

11. The three-legged stool of claim 7, further comprising a drink holder disposed on a second end of the cantilevered platform, opposite the first end.

12. The three-legged stool of claim 7, further comprising a retractable guitar holder pivotally disposed on the cantilevered platform.

13. The three-legged stool of claim 1, wherein at least one of the legs has multiple, spaced-apart sets of opposing grooves for supporting a removable, cantilevered platform at any one of multiple selectable heights.

14. The three-legged stool of claim 1, wherein each of the legs has substantially planar opposing faces defined by the leg's width and length dimensions and lying within vertical planes.

15. A three-legged stool comprising:

a seat oriented in a horizontal plane, the seat having a top and a bottom;

a quick-release leg-fastening assembly on the bottom of the seat;

three non-intersecting legs each having width, thickness, and length dimensions, and whose width dimension is at least two times its thickness dimension, each leg also having upper and lower sections;

the three legs being connected to the seat, by the quick-release leg-fastening assembly, at three symmetrically-spaced places on the seat; and a substantially planar leg bracket oriented below the seat and parallel with the horizontal plane, the leg bracket having three symmetrically-oriented elongated slots operable to receive and orient the legs;

wherein each leg's lower section is sized to fit through one of the leg bracket slots, but its upper section is sized to be too big to pass through the leg bracket slot, thereby limiting travel of anything more than the leg's lower section through the leg bracket slot;

wherein each leg extends downwardly and diagonally from the seat through one of the leg bracket slots, and into terminating contact with a support surface;

wherein the quick-release leg-fastening assembly comprises:

three multiple-walled terminal brackets, each terminal bracket being configured to grasp the upper section of one of the legs;

for each terminal bracket, a passageway through at least one of the walls of the terminal bracket; and a rotary lock pivotally attached to the bottom of the seat, the rotary lock having three arc-shaped arms sized to pass through the passageways of each of the terminal brackets between open and closed positions.

16. A three-legged stool comprising:

a seat oriented in a horizontal plane, the seat having a top and a bottom;

a quick-release leg-fastening assembly on the bottom of the seat;

three non-intersecting legs each having width, thickness, and length dimensions and whose width dimension is at least two times its thickness dimension;

the three non-intersecting legs being connected to the seat, by the quick-release leg-fastening assembly, at three symmetrically-spaced places on the seat; and a substantially planar leg bracket oriented below the seat and parallel with the horizontal plane, the leg bracket having three symmetrically-oriented elongated slots operable to receive and orient the legs;

wherein each leg extends downwardly and diagonally from the seat at an angle of between 45 and 75 degrees below the horizontal plane, through one of the leg bracket slots, and into terminating contact with a support surface;

wherein a terminal top edge of each leg has a keyhole slot for engaging a locking pin on the quick-release leg-fastening assembly, the locking pin having open and closed positions, the keyhole slot comprising a base shaped to partially encircle the locking pin and a passageway connecting the base to the terminal top edge, wherein the passageway is wide enough to allow passage of the locking pin therethrough in the locking pin's open position but too narrow to permit passage of the locking pin therethrough in the locking pin's closed position.

* * * * *